US005988093A

United States Patent [19]

Ni

[11] Patent Number: 5,988,093

[45] Date of Patent: Nov. 23, 1999

[54] FLOATING DOCK

[75] Inventor: James Jiann-Gwo Ni, Auckland, New Zealand

[73] Assignee: Orca Marine Company Limited

[21] Appl. No.: 08/983,229

[22] PCT Filed: Jul. 12, 1996

[86] PCT No.: PCT/NZ96/00073

§ 371 Date: Jan. 9, 1998

§ 102(e) Date: Jan. 9, 1998

[87] PCT Pub. No.: WO97/02983

PCT Pub. Date: Jan. 30, 1997

[30] Foreign Application Priority Data

Jul. 13, 1995 [NZ] New Zealand ..... 272569
Aug. 28, 1995 [NZ] New Zealand ..... 272871

[51] Int. Cl.[6] ..... B63B 59/00

[52] U.S. Cl. ..... 114/222

[58] Field of Search ..... 114/256, 258, 114/263, 44, 45, 221, 222

[56] References Cited

U.S. PATENT DOCUMENTS 3,734,048 5/1973 Michaelsen ..... 114/222
3,752,109 8/1973 Seiple ..... 114/222
4,007,701 2/1977 Fike ..... 114/222
4,043,286 8/1977 Doty ..... 114/222
4,784,078 11/1988 Feurt ..... 114/222

FOREIGN PATENT DOCUMENTS

WO 94/23993 10/1994 WIPO .
WO 95/06584 3/1995 WIPO .

*Primary Examiner*—D. Glenn Dayoan
*Assistant Examiner*—Patrick Muldoon
*Attorney, Agent, or Firm*—Anthony J. Casella; Gerald E. Hespos

[57] ABSTRACT

A floating dock is provided for efficiently cleaning ship hulls and for reducing pollution problems associated with the cleaning of ship hulls. A method for cleaning ship hulls with a floating dock also is provided. The floating dock is ballasted and independently manoeuvrable. The floating dock has a ship hull receiving section which can be submerged at least partly so that a base part of the ship hull receiving section may be positioned beneath a ship hull. Cleaners are provided on at least one inner side of the ship hull receiving section to contact a side of the ship hull, and a debris collector may be provided to collect debris removed from the cleaning operation for later processing or dumping at a remote site. The floating dock can be self propelled forward and backward to reach the ship and can be self propelled laterally to clean the ship.

21 Claims, 12 Drawing Sheets

FLOATING DOCK

TECHNICAL FIELD

This invention relates to a method and apparatus for cleaning a ship hull, and in particular to a manoeuvrable floating dock.

BACKGROUND ART

Barnacles and marine growth on the hulls of ships, below the water line, are a significant factor in reducing the efficiency of marine shipping. There are two methods by which this problem has been addressed. The first has been the development of various anti-fouling paints. In general these paints include the composition tributyltin (TBT). For example, the most commonly used anti-fouling paint systems currently in use are the TBT-self-polishing copolymer (SPC) systems. TBT is toxic to marine life and also to humans. TBT can enter the environment in significant concentrations where ships sit in shallow relatively stationary water, and also as a result of ship hull cleaning. Thus, the use of TBT-containing paints is on the decline. Indeed, a number of countries have now banned the use of paints including TBT, or are in the process of passing legislation to prohibit its use. Alternative, non-TBT containing antifouling paints are being developed and tested but these tend to be effective for a shorter period and/or may be effective only against marine growth of selected types.

The second option for dealing with barnacles and marine growth is to conduct regular cleaning of ship hulls. Traditionally, ship hulls have been cleaned by divers operating small submarine machinery with steel brushes to brush off the barnacles and marine growth. However, this is a very time consuming process, the efficiency of the cleaning is questionable and the debris, which generally includes some possibly toxic paint, is discarded on the seabed at the mooring site of the ship (usually in a port).

Thus, it is an object of the present invention to provide a method and apparatus for cleaning the hull of a ship which reduces or overcomes the abovementioned problems, or which at least provides the public with a useful alternative.

Other objects of the invention may become apparent from the following description which is given by way of example only.

DISCLOSURE OF INVENTION

According to one aspect of the present invention there is provided a floating dock comprising a ship hull receiving means adapted to accommodate the beam of a ship, buoyancy means to control buoyancy of the receiving means, lateral cleaning means adapted to contact and clean at least a part of a side of a ship hull, adjustment means adapted to adjust the position of the lateral cleaning means to accommodate ships of different beam and self propulsion means adapted to manoeuvre the receiving means both to and from moored ships and along the length of a moored ship hull, and wherein said adjustment means and self propulsion means operate independently of a ship to be cleaned.

In a further preferred form the floating dock of the present invention may further comprise support means adapted to support a base of the receiving means, when in use, beneath the ship hull.

The receiving means of a floating dock of the present invention may preferably comprise a substantially U-shaped hull, said hull having a base part and lateral towers. Preferably, the buoyancy means may provide buoyancy to at least the base, and preferably also to each of the lateral towers.

In one preferred form of the floating dock of the present invention there may be lateral cleaning means associated with each lateral tower and bottom cleaning means. Each cleaning means may comprise a plurality of brushes in rotatable disc form.

In one preferred form of the invention the plurality of brushes forming a lateral cleaning means may be adjustable collectively on one or more lateral panels. Preferably the adjustment means enable lateral movement, as well as tilt and/or rotation of the lateral panels about a vertical axis.

Alternatively, the or each lateral cleaning means may comprise a plurality of separate cleaning panels, each cleaning panel being separately adjustable and having a plurality of brushes.

In a preferred form of the invention the adjustment means may comprise hydraulically controlled telescopic arms, a plurality of which may control the adjustment of the or each lateral panel, or each one of which may control the adjustment of a single cleaning panel.

In a further preferred form, the floating dock of the present invention may further comprise a collection means adapted to collect debris cleaned off a ship hull by the floating dock. Preferably, the collection means may comprise a collection chamber and dumping or removal means for dumping collected debris at a remote site or removing collected debris internally to the floating dock for subsequent processing or dumping.

According to an alternative aspect of the present invention there is provided a method of cleaning a ship hull when in substantially open water, said method comprising:

manoeuvring a floating dock to a moored ship by self-propulsion means;

submerging at least a part of a ship hull receiving means of the floating dock adapted to clean ship hulls and accommodate the beam of a ship, beneath the ship hull;

contacting cleaning means of the floating dock with a part of at least one side of the ship hull;

operating the cleaning means, and manoeuvring the floating dock by the self-propulsion means substantially the length of the ship hull to clean at least one side thereof.

In a preferred form of this aspect of the present invention cleaning means may be contacted on both sides of the ship hull to enable cleaning of each side simultaneously.

In one preferred form, the method of the invention may further comprise adjusting the or each cleaning means substantially to follow the contour of the ship hull.

In a further preferred form of the invention cleaning means may also contact the bottom of the ship hull.

In another preferred form, the method of the invention may further comprise collecting material cleaned off the ship hull for subsequent processing and/or dumping remote from the site of cleaning.

According to a further aspect of the present invention there is provided a cleaning panel adapted for cleaning the hull of a ship, said panel comprising a plurality of brushes in the form of rotatable discs, said brushes configured in at least two rows, one row offset in relation to an adjacent row, and at least one brush connected by hinging means to the rest of the panel, said one or more hinging means biased to maintain its associated brush in the plane of the panel at rest.

Further aspects of the present invention will become apparent from the following description which is given by way of example only, and with reference to the accompanying drawings, in which:

MODES FOR CARRYING OUT THE INVENTION

The floating dock 1 of the present invention may comprise a hull or superstructure 2, adjustable lateral arms 3, cleaning means 4*a*, 4*b* and one or more drive means 5*a*, 5*b*, 5*c* for propelling the dock.

Figure 1:
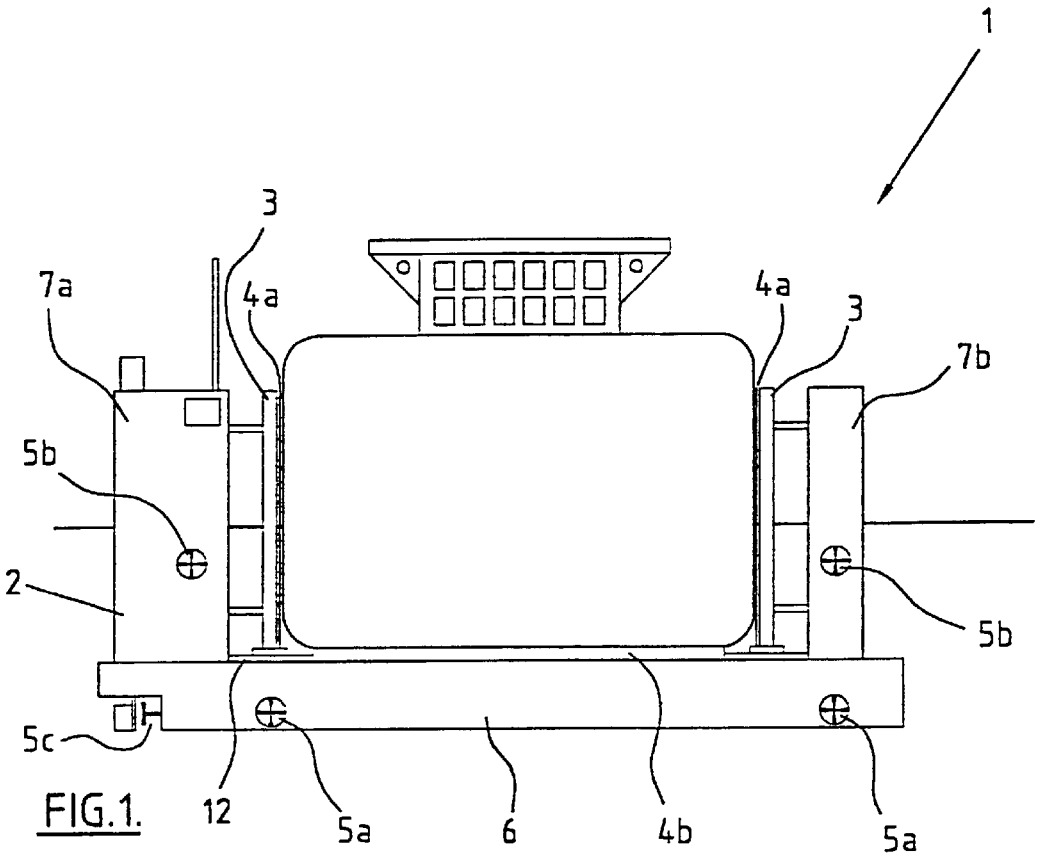
FIG. 1: Shows a plan view from the side of a floating dock of the present invention in one embodiment, with a ship in position for cleaning.

The hull 2 may comprise a base part 6 and lateral towers 7*a*, 7*b*. In the embodiment shown in FIG. 1 one lateral tower 7*a* is more substantial than the other 7*b* since the drive means, hydraulic controls and bridge of the floating dock are accommodated in or on this lateral tower 7*a* in this embodiment. However, it will be appreciated that the specific configurations of the lateral towers 7*a*, 7*b* are not essential to the invention, and in other embodiments the lateral towers 7*a*, 7*b* may be symmetrical, each housing functional equipment.

At least a part of the hull 2 may provide buoyancy to the floating dock 1. This buoyancy may be provided in the base 6, lateral towers 7*a*, 7*b* and/or a combination of these. There may be means for controlling the degree of buoyancy to enable the floating dock 1 to be floated or substantially submerged for operation.

The floating dock 1 is manoeuvrable by virtue of having its own drive means. In the embodiment shown in FIG. 1 there may be propellers 5*c* to move the floating dock 1 forwards and backwards, and additional propellers 5*a* to move the dock 1 laterally. In embodiments of the invention having large lateral towers it is envisaged that additional lateral propulsion means 5*b* will be required to ensure stability of the floating dock when in use. Whilst in the embodiments shown in the drawings propulsion of the floating dock 1 is provided by propellers, it will be appreciated that other means of self-propulsion are anticipated and included within the scope of this invention. In the embodiment of the invention shown in FIGS. 13 and 14 propulsion is provided by rotatable motors 40 (e.g. AZIPOD motors), positioned at either end of the floating dock, with an additional, reversible, central propulsion means 41.

Whilst the embodiments shown in the drawings include drive means to enable independent manoeuvrability of the floating dock it will be appreciated that the cleaning operation performed by the dock could equally be achieved by mooring the dock and driving or towing ships through the dock when partially submerged. In that case a dock of the present invention would not require separate drive means.

Figure 2:
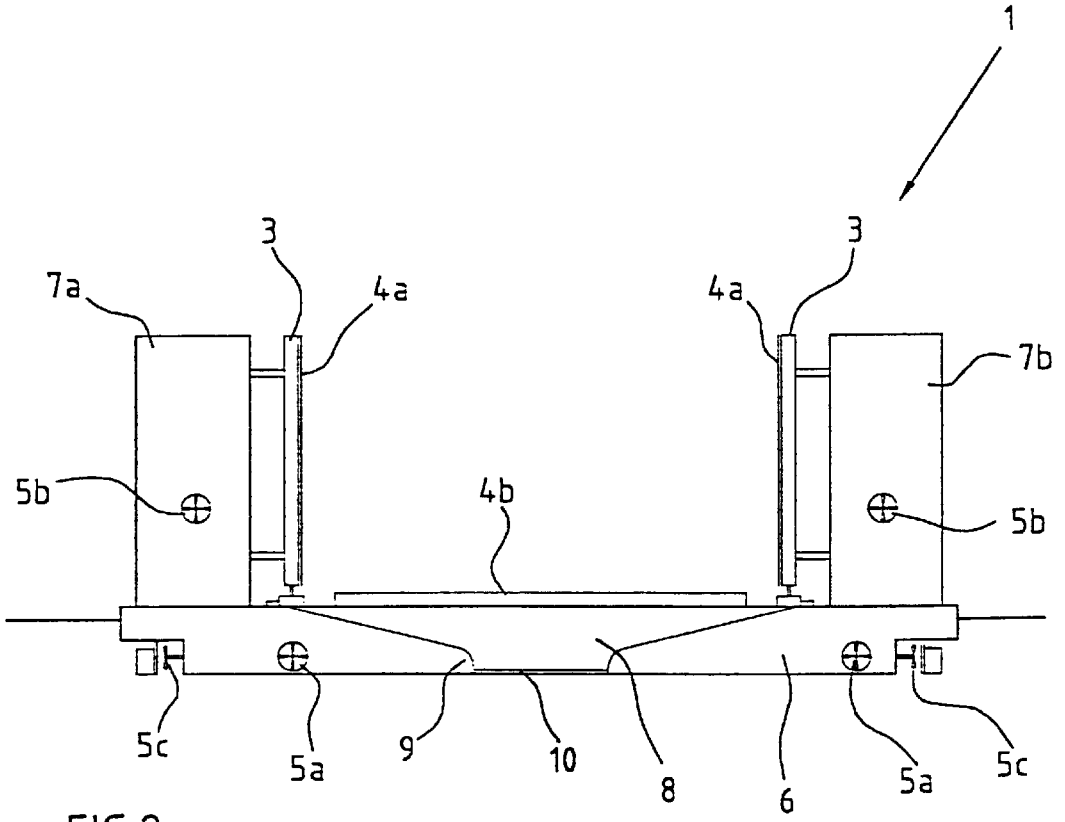
FIG. 2: Shows a plan view from the side of a floating dock of the present invention in an embodiment incorporating a means for disposing of collected debris.
Figure 3:
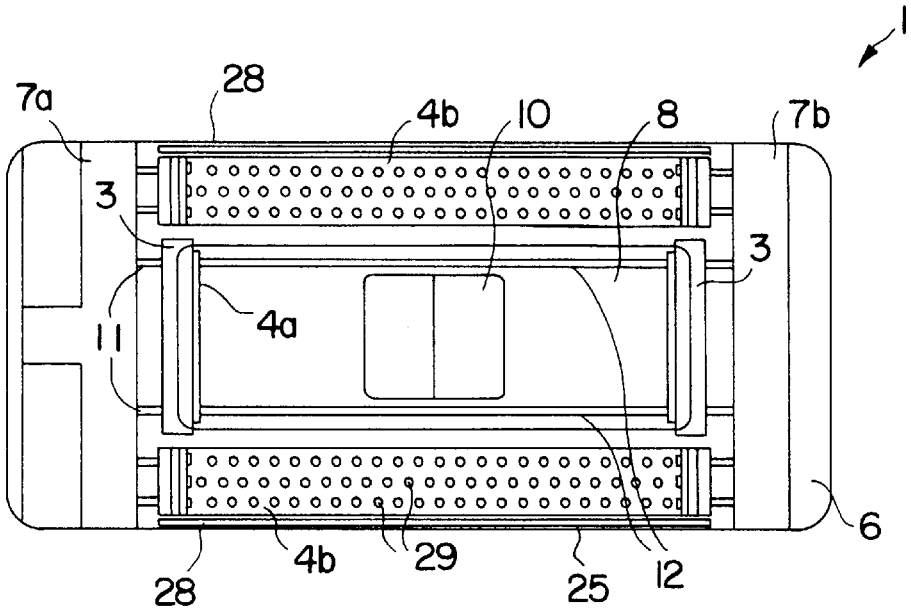
FIG. 3: Shows a plan view from above of a floating dock of the present invention in one preferred embodiment.

In one preferred form of the invention, and as shown for example in FIGS. 2, 3 and 13–15, there may be a means for collecting debris removed by the cleaning means 4*a*, 4*b*. There may be one or more collection means 8 positioned in a central upper part of the base 6. When in operation the design of the floating dock 1 may be adapted to direct removed debris into the collection means 8. At a lower part 9 of the collection means 8 there may be dump doors 10 through which collected debris may be discarded, as shown in FIGS. 2 and 3.

Figure 13:
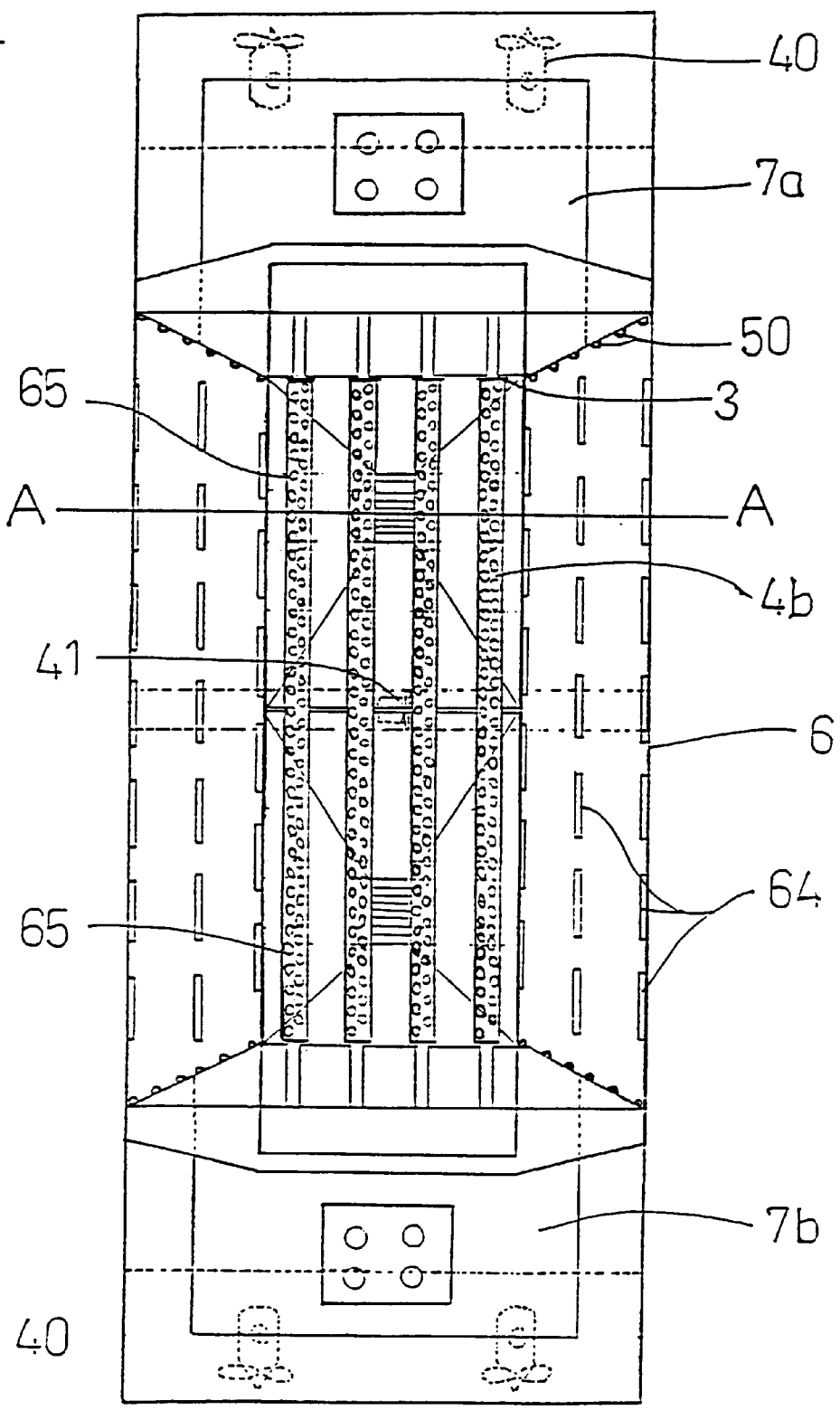
FIG. 13: Shows a side view of an alternative embodiment of a floating dock of the present invention.
Figure 14:
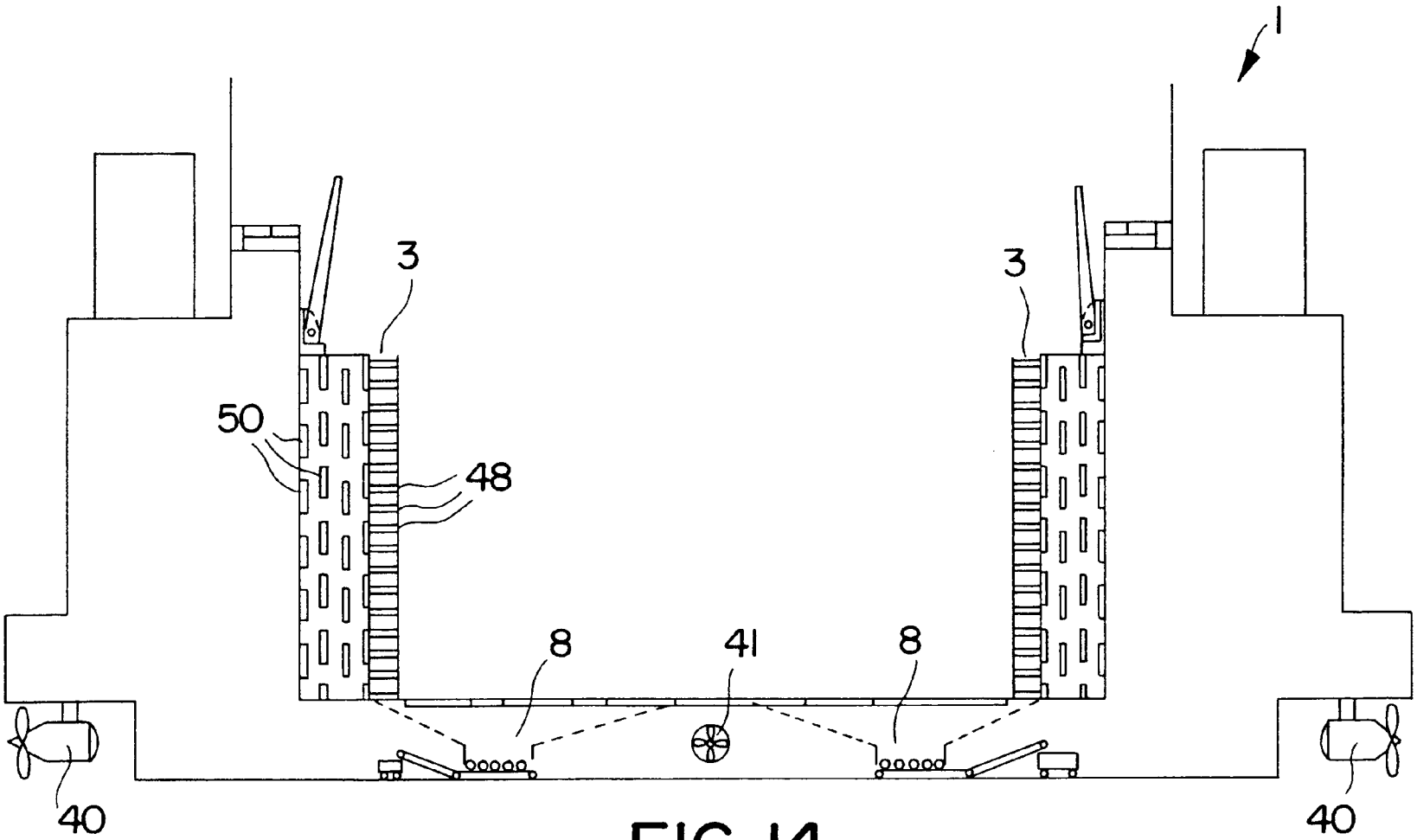
FIG. 14: Shows a view from above of the embodiment of FIG. 13.
Figure 15:
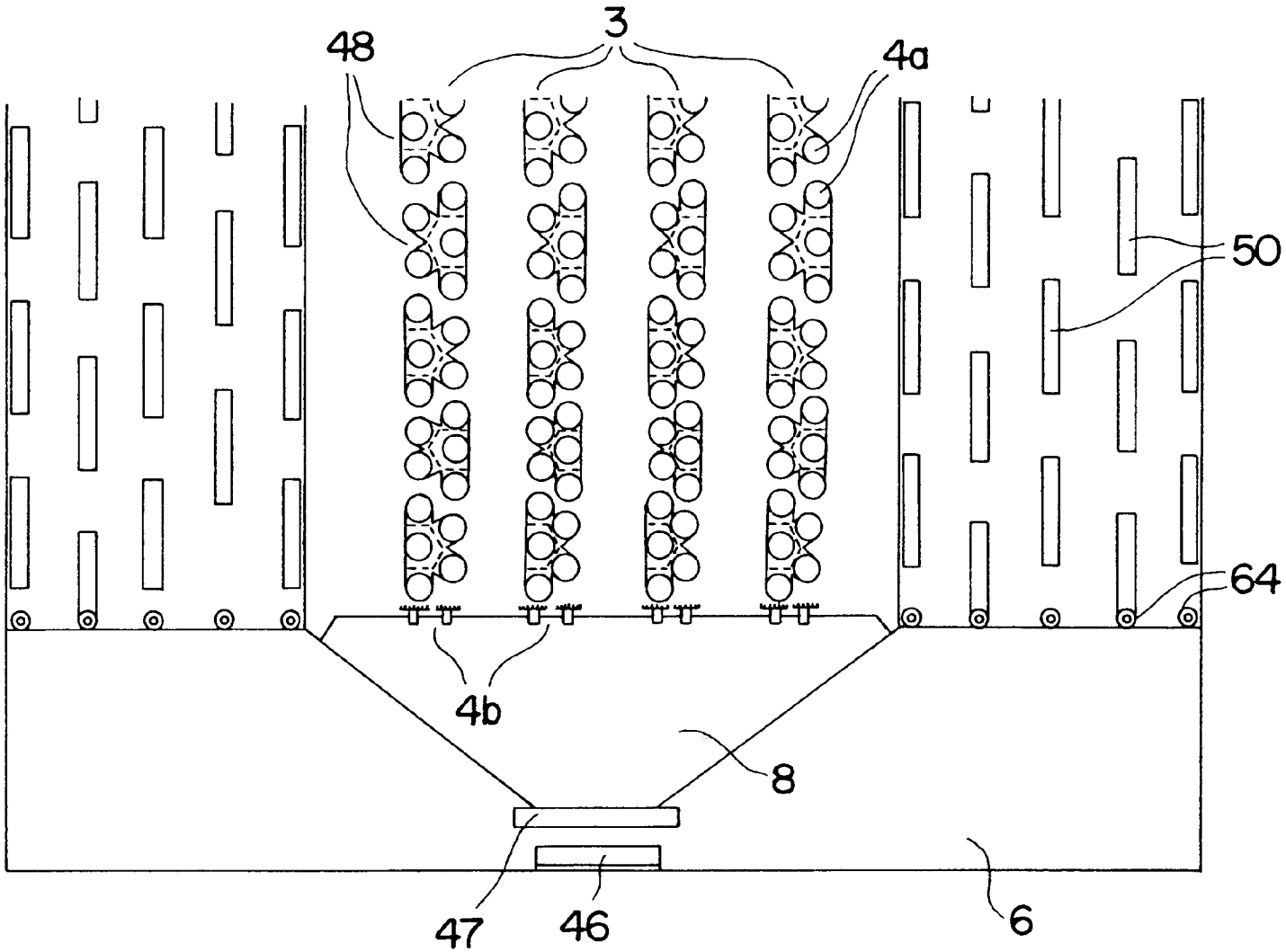
FIG. 15: Shows a cross-section through A—A of FIG. 13.
Figure 18:
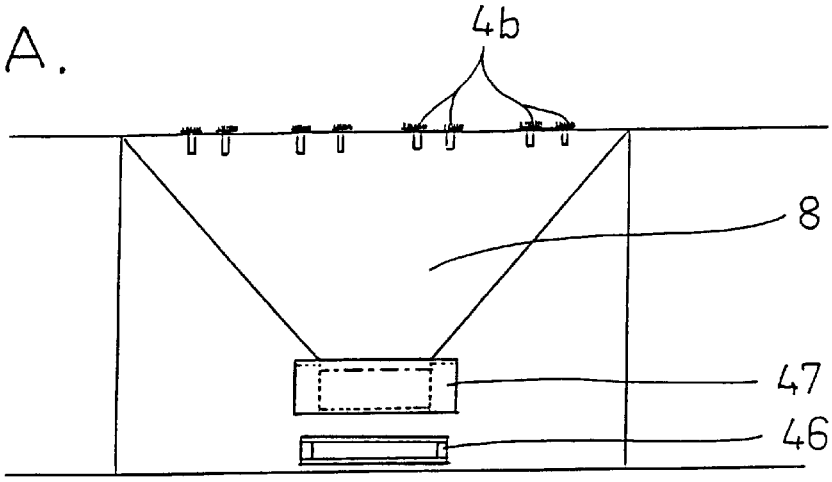
FIG. 18: Shows (A) transverse and (B) longitudinal cross-sections through a debris recovery part of a floating dock of the present invention in the embodiment of FIGS. 13–15.
Figure 18:
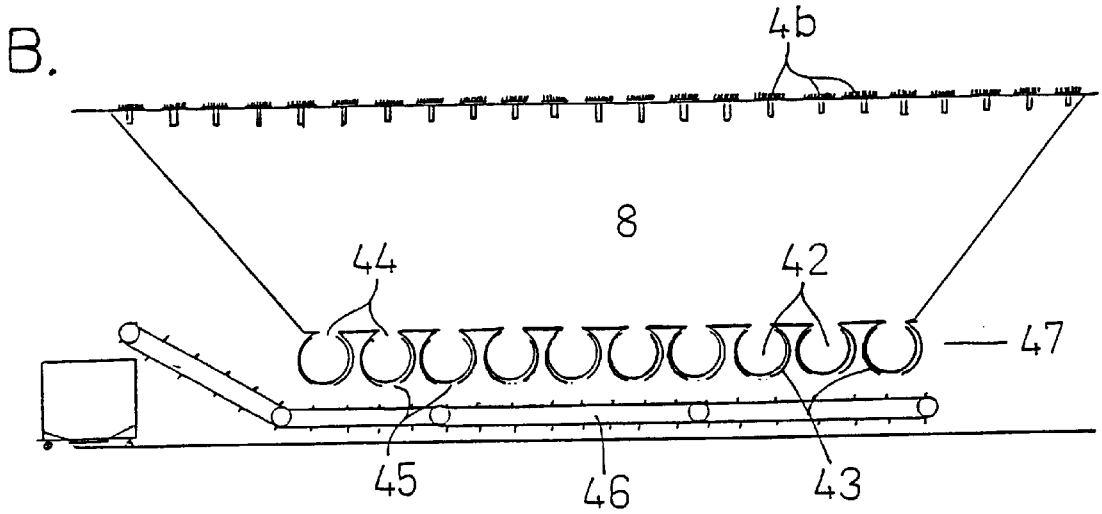

In the alternative embodiment of FIGS. 13 to 15, and also with reference to FIG. 18, the collection means 8 may collect debris internally for subsequent processing and/or disposal. Referring to FIG. 18, such a collection means 8 may comprise a receiving means 47 comprising a plurality of cylindrical containers 42, rotatable in cylindrical housings 43. The containers 42 may be rotatable between a collecting position in which an open part 44 of the container faces upwards to receive debris, and a dumping position in which the open part 44 faces downwards for dumping the debris through corresponding openings 45 in the cylindrical housings 43 on to conveyor 46. It will be appreciated that this type of dumping system requires appropriate sealing between the cylindrical containers 42 and their housings 43 to enable operation of the collection means whilst the lower part of the floating dock 1 is submerged when in operation.

Debris and any contaminated water would be transferred by the conveyor to appropriate means for transporting the material from the vessel at a later time.

In one embodiment, as shown in FIGS. 1 to 9, the lateral arms 3 may comprise a substantially vertically disposed panel 37, cleaning means 4*a* interconnected to a front surface 38 of the panel 37, and fenders 39 adjacent longitudinal edges 40 of the front surface 38. The lateral arms 3 may be connected by hydraulic rams 11 to their corresponding lateral towers 7*a*, 7*b*. In the embodiment shown in FIGS. 1 to 9 there may be upper and lower pairs of hydraulic rams 11. These hydraulic rams 11 are adapted to move the lateral arms 3 inwards and outwards along rails 12, as shown in FIG. 3. Thus, the base part of each lateral arm 3 may be supported on support means 13 adapted to interconnect with rails 12.

Figure 10:
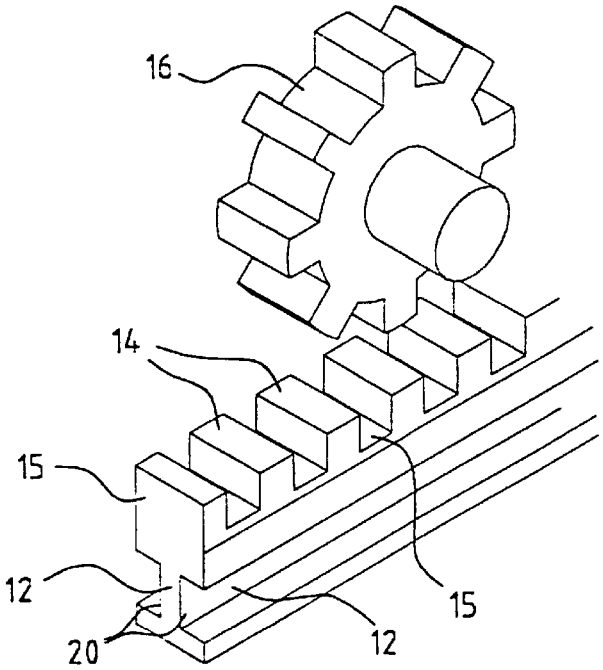
FIG. 10: Shows a perspective view of a part of a rail of a floating dock of the present invention in one embodiment, and an expanded view of a cog adapted to support and interconnect a lateral arm with the rail.

In one form of the invention, as shown in FIG. 10, the rail 12 may be in the form of a girder with cogs 14 on an upper surface 15. Wheel cog(s) 16 at an upper inner part 17 of the support means 13 may be adapted to intermesh with the cogs 14 of the rail 12. At a lower part 18 of the support means 13 there may be wheels 19 adapted to travel in the recesses 20 of the rail 12. In the embodiment shown in FIGS. 6 to 9 the support means 13 may interconnect with their lateral arm 3 via interconnection means 21 which enable the lateral arm 3 to tilt and swivel in relation to the support means 13.

Figure 6:
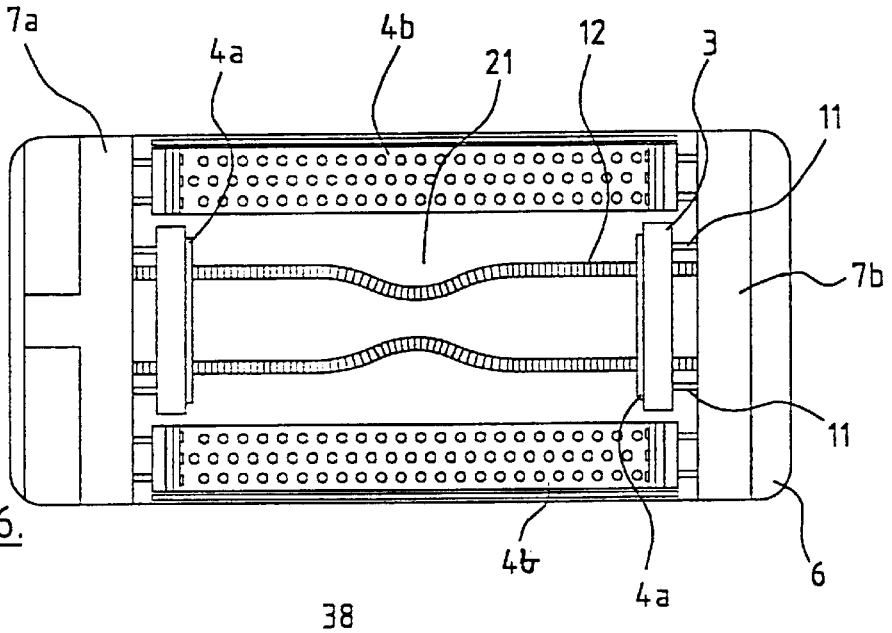
FIG. 6: Shows a plan view from above of a floating dock of the present invention according to an alternative embodiment.
Figure 7:
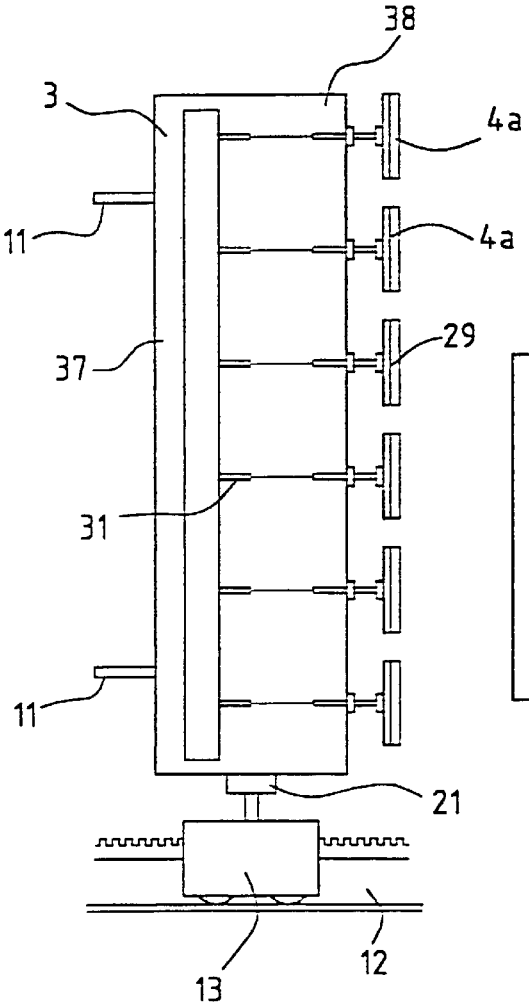
FIG. 7: Shows a side plan view of a lateral arm of the floating dock of FIG. 6.
Figure 8:
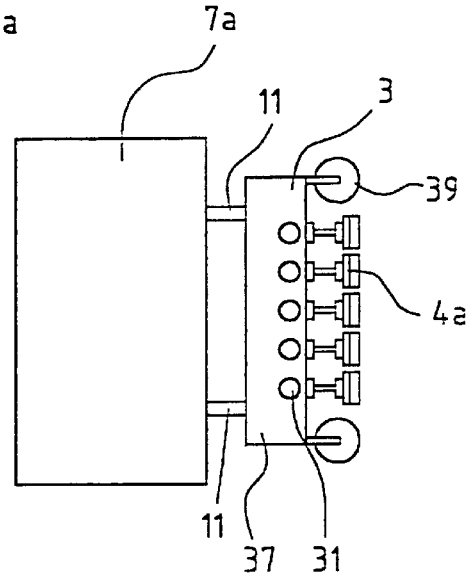
FIG. 8: Shows a longitudinal cross section through the lateral arm of FIG. 7, attached to a lateral tower.
Figure 9:
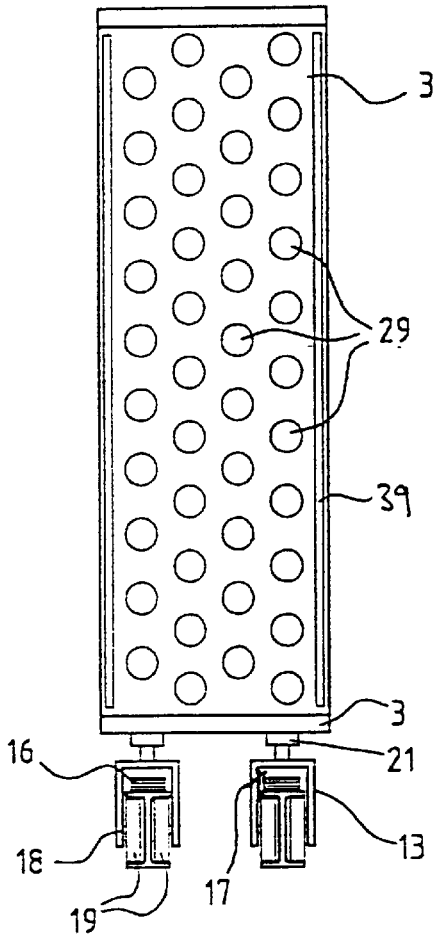
FIG. 9: Shows a front view of the lateral arm of FIG. 7.

In the embodiment shown in FIG. 6 the rails 12 initially run parallel to one another towards each end of the floating dock 1 but curve inwards towards a mid-part 21. With this configuration a lateral arm 3 can be made to swivel or rotate by extending the hydraulic rams 11 on one side of the lateral arm 3 to a greater extent than on the other side when the lateral arm reaches the curve of the rail. This pivoting action enables the lateral arms 3 to follow the contour of the hull of a ship, for example towards the bow and stern of the ship.

The lateral arms 3 may also be caused to tilt about the connections means 21 through separate control of the upper and lower pairs of hydraulic arms 11.

Figure 4:
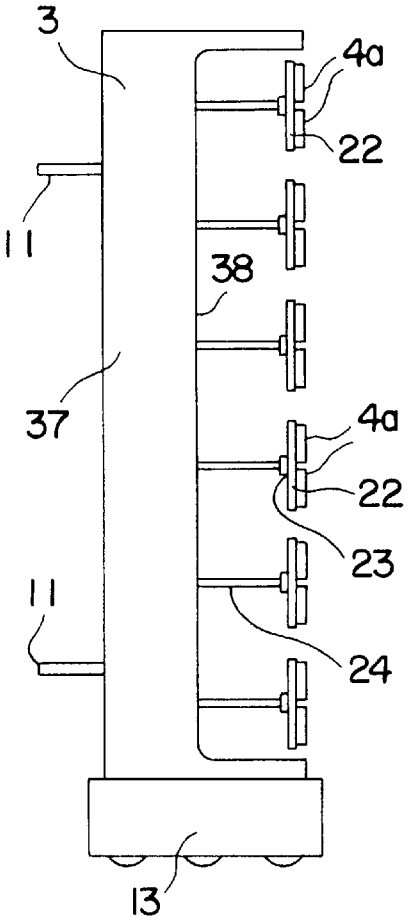
FIG. 4: Shows a vertical cross-section through a lateral arm of the floating dock of FIG. 3.
Figure 5:
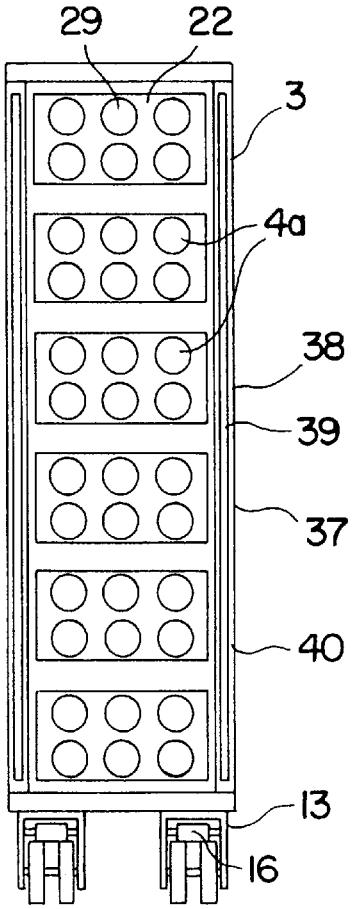
FIG. 5: Shows a front view of the lateral arm of FIG. 4.

In the embodiment of the floating dock 1 of the present invention shown in FIGS. 3 to 5 an alternative means is employed to enable the apparatus to adapt to the contour of a ship's hull. In this embodiment the cleaning means 4*a* rather than the lateral arms 3 are adapted to tilt and swivel. Thus, the rails 12 may be parallel and there is no requirement for the lateral arms 3 to swivel in relation to the support means 13. The cleaning means 4*a* may be positioned on a series of panels 22, as shown in FIGS. 4 and 5. Each panel 22 may be connected via a universal joint 23 to a hydraulic arm 24 extending from the lateral arm 3. Thus, each panel 22 is adjustable towards or away from the lateral arm 3 by its hydraulic arm 24. Further, when pressure is applied between the cleaning means 4*a* and the side of a ship hull the universal joint 23 enables the plane of the panel 22 to conform substantially to the contour of the ship hull.

Figure 16:
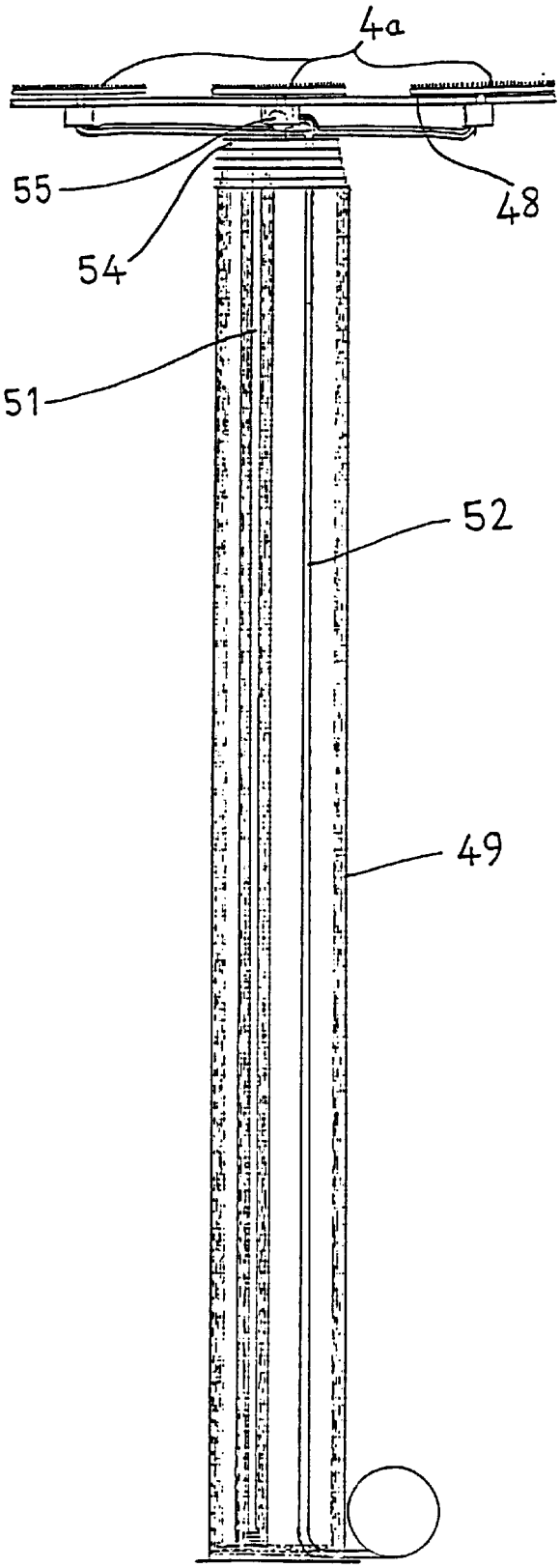
FIG. 16: Shows a longitudinal cross-section through a telescopic arm or hydraulic ram employed in a floating dock of the present invention.

A third alternative embodiment of the configuration of lateral arms 3 is shown in FIGS. 13 to 17. In this embodiment there are four sets of lateral arms on each side of the floating dock. It will be appreciated that the number of sets of lateral arms is not an essential feature of the invention, the minimum number being one set, and the maximum dependent on cost and practicality. In this embodiment the cleaning means 4*a* are in cleaning panels 48 each of five brushes. Each panel 48 has its own hydraulically controlled telescopic arm 49, and its lateral position is therefore independently adjustable. In this embodiment, lateral fenders 50 are provided on inner sides of the floating dock 1 adjacent the lateral arms 3. FIG. 16 shows details of a telescopic arm 49. The arm 49 incorporates hydraulic pipe 51 for controlling movement of the telescopic arm 49, and separate retractable hydraulic pipes 52 for providing power to each of the five cleaning means 4*a*. A panel 48 is attached to the outer end 54 of the telescopic arm 49 via a universal joint 55.

Figure 17A:
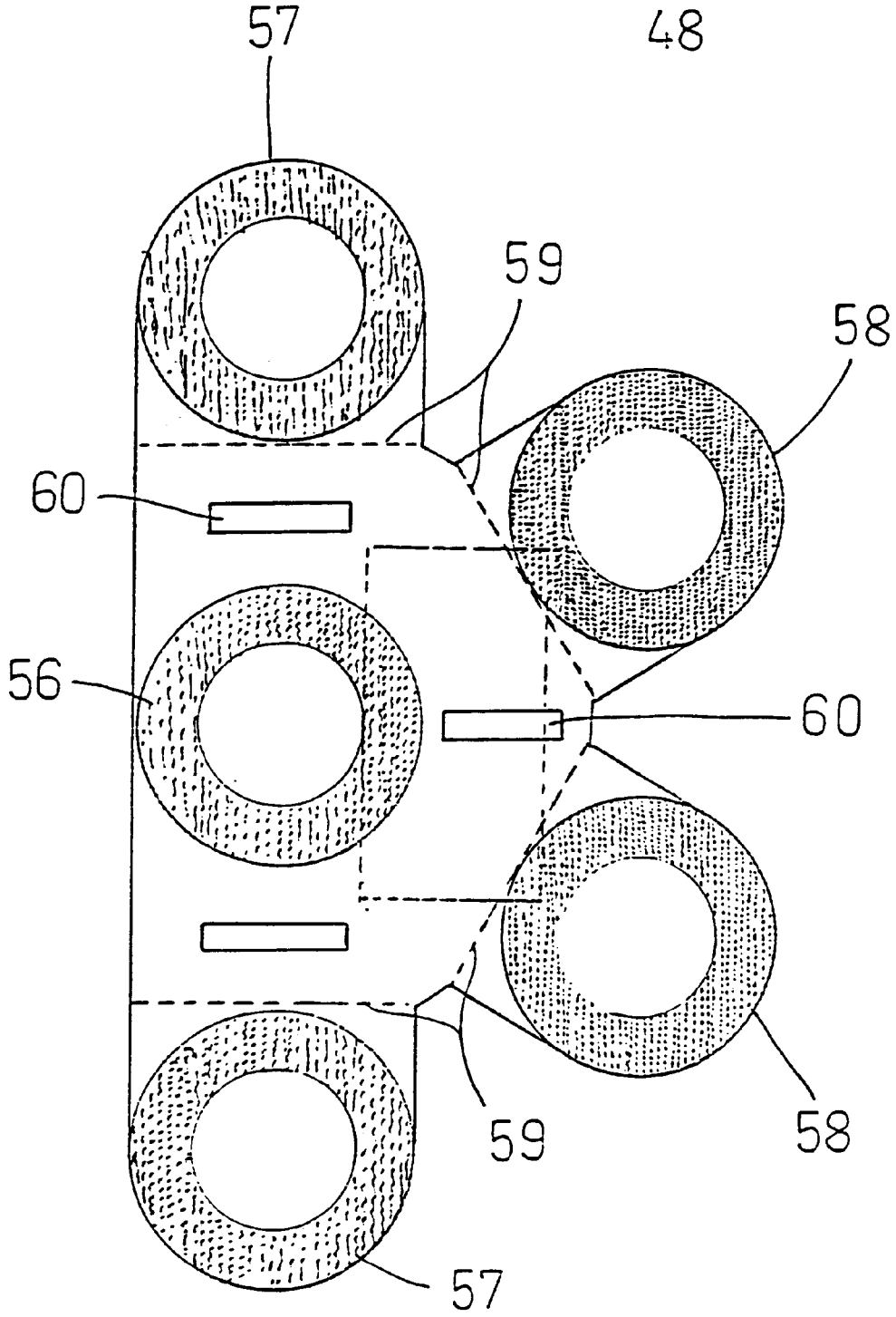
FIG. 17: Shows views from (A) the front and (B) the rear of a panel of cleaning brushes employed in the embodiment of the floating dock of FIGS. 13–15.

FIG. 17 shows a configuration of a preferred panel 48 of this embodiment of the invention. Referring to FIG. 17A, there is a central brush 56, two outer, hinged brushes 57 positioned in line with this central brush 56, and two further, hinged, displaced brushes 58. The displaced brushes 58 are so positioned as to cover the gaps between the other three in-line brushes 56, 57. The hinges 59 are biased to maintain brushes 57, 58 in a substantially flat plane, at rest. When uneven pressure is applied to the panel 48, for example when being forced against a bow or stern part of a ship hull, the hinges 59 enable the position of the brushes 57, 58 to adapt to the hull contour. This adaptation is further facilitated by adjacent panels 48 on a lateral arm 3 being inverted, as shown in FIG. 15.

Rollers or wheels 60 may be positioned between brushes on a panel 48, as shown in FIG. 17A, controlling the distance between a panel 48 and a ship hull, and facilitating lateral movement of a panel along a ship hull.

Figure 17B:
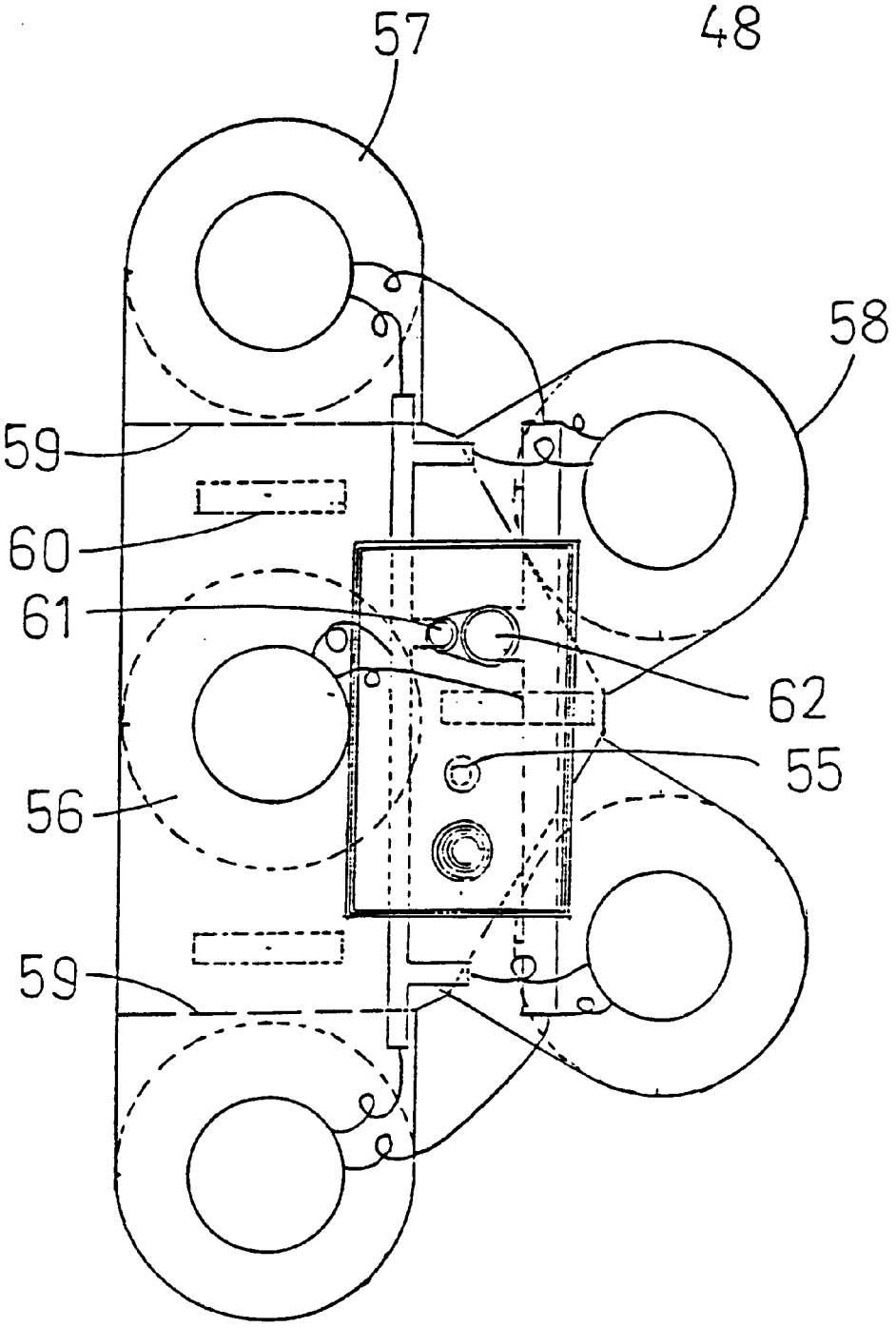

A hydraulic pressure supply line 61 is provided to each brush, and a low pressure return line 62 (see FIG. 17B).

Additional cleaning means 4*b* may be positioned on an inner surface 25 of the base 6 of the hull or superstructure 2. In most cases there is minimal marine growth beneath the bottom of a ship's hull, primarily because of the absence of light. Thus, it is not essential that there be cleaning means to clean the bottom of a ship hull, in which case the bottom cleaning means 4*b* can be replaced with some other form of support means, for example rollers or interspersed wheels, which when the floating dock is in use allow the base 6 of the dock 1 to be supported on and run along the bottom of the ship.

It will be appreciated that a floating dock 1 of the present invention could operate effectively without any support between the base 6 and the bottom of the ship, for example by appropriate control of the depth of submersion of the floating dock 1 by the buoyancy control means.

In the embodiments of FIGS. 3 and 6 bottom cleaning means 4*b* are shown towards outer parts of the inner surface 25 of the base 6 leaving the central part free for the rails 12 and collection means 8. A fender 28 may be located outwardly of each bottom cleaning means 4*b* on each side of the inner surface 25 of the base 6. These fenders 28 serve two purposes, the first being to control the distance between the base 6 and the bottom of the hull of a ship during operation of the dock 1, and the second being to contain material cleaned off the ship hull within the confines of the floating dock 1, avoiding contamination of the local environment.

An alternative configuration of bottom cleaning means 4*b* and fenders 64 is shown in the embodiment of FIGS. 13 to 15. In this case the bottom cleaning means 4*b* are positioned in sets corresponding with the sets of lateral arms. The sets of bottom cleaning means 4*b* do not need to be formed into the panel-type grouping of the lateral cleaning means 4*a*, since most do not need to pivot or tilt. However, individual cleaning means 4*b* towards the outer parts 65 of each set may have separate control means adapted to raise and/or adjust the angle of the cleaning means 4*b* to facilitate cleaning of the angled part of a hull between the bottom and sides of a ship.

The bottom fenders 64 in this embodiment may comprise rollers adapted to facilitate movement of the floating dock 1 along the bottom of the hull of a ship.

Figure 11A:
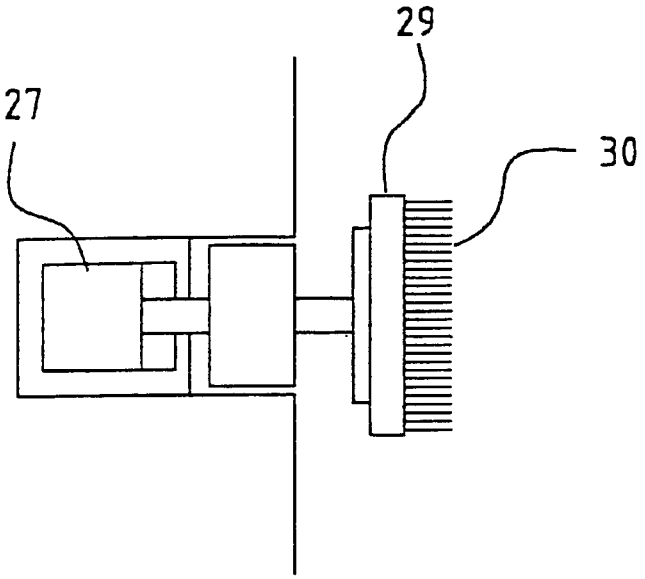
FIG. 11: Shows two alternative embodiments (A and B) of an individual brush which forms part of the cleaning means of a floating dock of the present invention.

Essentially, the cleaning means 4*a*, 4*b* may comprise rotatable brushes 29, examples of which are shown in FIGS. 11A and B. It will be appreciated that the invention is not restricted to any particular pattern or configuration of cleaning means 4*a*, 4*b*. Preferably, however there will be more than one row of brushes, with one offset in relation to the next to provide optional removal of marine growth. Nor is the invention restricted to cleaning means in the form of brushes. Other forms of pads or abrasive means are also envisaged, which may rotate, vibrate, oscillate or the like to effect cleaning.

Figure 11B:
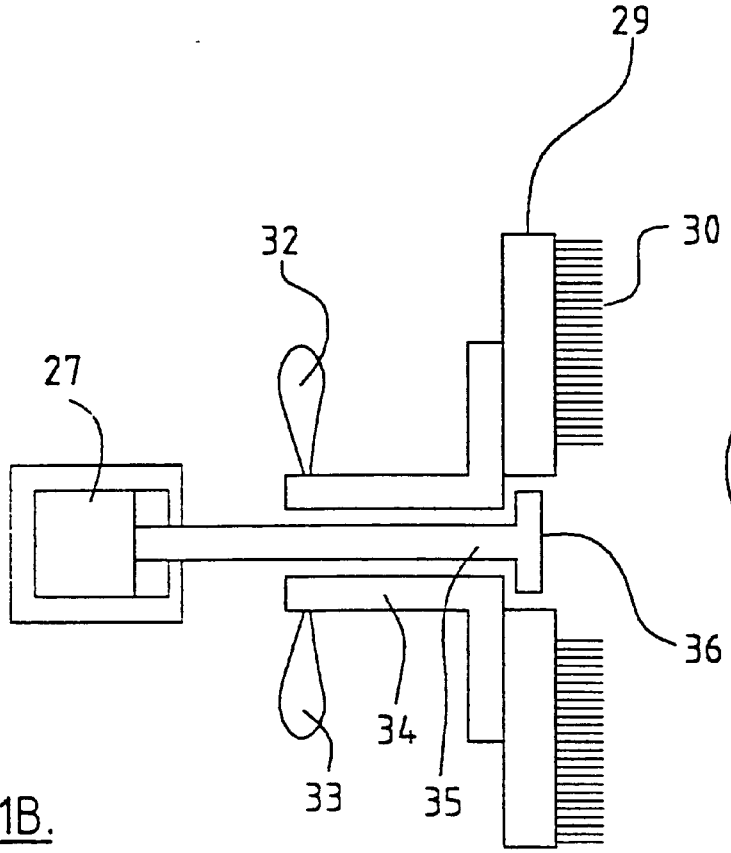
Figure 12:
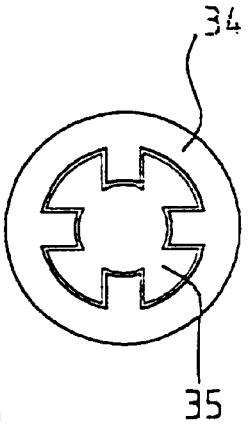
FIG. 12: Shows a cross-section through a drive shaft of a bush of the present invention in one preferred embodiment.

Each brush 29 has an outer surface of bristles 30, preferably of steel or nylon reinforced with, for example, graphite. Each brush 29 also has a drive means 27 for rotating the brush. This may be a hydraulic drive means. In addition, there may be means provided to enable each brush 29 or a panel of brushes to apply pressure to the side of a ship's hull. This means may be by independent hydraulic controls 31 for each brush 29 (see for example FIGS. 7 and 8), by hydraulic arms controlling panels of brushes (as in FIGS. 4 and 5 or 16), and/or by impelling means 32 (see FIG. 11B). In the latter situation each brush 29 may be interconnected with a small propeller 33 by an elongate shaft 34. The shaft 34 may be adapted to slidingly engage with the drive shaft 35 (as, for example shown in FIG. 11C) such that when the drive means 27 causes the brush 29 to rotate, the propeller 33 also rotates impelling the bristles 30 of the brush forwards either until they contact the ship hull or until the bush 29 abuts a stop means 36 at the end of the drive shaft 35.

It is envisaged that under different circumstances different types of brush 29 may be required with the floating dock 1 of the present invention. Thus, the panels 22, 48 and/or each individual cleaning means or brush may be interchangeable. For example, a ship hull heavily encrusted with barnacles will require cleaning with steel wire brushes. In contrast, ships previously painted with potentially toxic anti-fouling paints, and with mild marine growth, would preferably be cleaned with nylon brushes to avoid paint damage.

Where there are a plurality of sets of lateral arms 3, each set may carry cleaning means 4*a* adapted to deal with fouling of a different type or intensity, for example a first set might have coarse cleaning means, a second medium cleaning means and a third fine cleaning means.

Use of a floating dock 1 of the present invention will now be described.

In a buoyant condition (see FIG. 2) the floating dock 1 can be manoeuvred as a conventional ship to the site of mooring of a ship requiring cleaning. The floating dock 1 can then be submerged to the required depth to enable the base part 6 to be supported beneath one end of the hull of a ship. The position of the lateral cleaning means 4*a* are then adjusted to contact the sides of the ship by movement of the lateral arms and/or separate control of individual or panels of cleaning means. In this position the floating dock 1 is in contact with the ship hull via lateral and bottom fenders or rollers.

Buoyancy/ballasting of the floating dock 1 may be adjusted to ensure substantially even pressure at the contact points between the ship and the floating dock 1.

The cleaning means 4*a*, 4*b*, in the form of brushes or the like are then caused to operate in their cleaning action. At the same time the propulsion means 5*a*, 5*b*, are used to direct the movement of the floating dock 1 along the length of the ship hull. In the embodiment of FIGS. 1 to 9 the hydraulic rams 11 control the position of the lateral arms 3 to ensure that their gross position follows substantially the contour of the ship hull, whilst individual control of the brushes 29 by independent hydraulic controls 31 and/or impelling means 32, or of panels 22 of brushes by hydraulic arms 24, ensures that appropriate pressure is applied between the brushes and the hull at all times. In the embodiment of FIGS. 13 to 15 the required degree of control is provided through the separate control of each cleaning panel 48.

As well as controlling contact between the ship and the floating dock, the fenders 28, 39, 64 also ensure that debris removed from the ship hull by the cleaning means 4*a*, 4*b* is confined to the central inner part of the floating dock 1, so that it settles into the collection means 8. Rotation of the brushes 29 may also assist in directing the debris into the collection means 8.

Once the floating dock 1 has passed from one end to the other of a ship, cleaning substantially the full length, it may be refloated and manoeuvred to the next waiting ship. Once the collection means is full, or the containers receiving debris from the conveyor in the embodiment of FIGS. 13 to 18 are full, the floating dock 1 may proceed to a preferred site for dumping or unloading of collected debris.

It is envisaged that the floating dock of the present invention will be able to clean the hull of most medium to large ships, and will be able to clean at least 90 percent of the hull of such ships.

The invention has been described by way of example, and with particular reference to preferred embodiments. Variations and modifications are anticipated. For example, it is envisaged that a lower part of each lateral arm 3 may include a plurality of water jets for cleaning the transition area between the sides and bottom of a ship hull. It is also envisaged that video equipment may be employed to monitor the positioning and progress of the cleaning means.

A further anticipated modification of the embodiment of FIGS. 1 to 9 involves replacement of the lower pair of hydraulic rams 11 connecting the lateral arms 3 with the lateral towers 7*a*, 7*b* with a drive means acting directly on the wheel cogs 16 of the support means 13.

It will also be appreciated that pressure sensors may be employed to control movement of the lateral arms 3 and positioning of the cleaning means 4*a*, 4*b*. Such sensors may be located in the fenders 28, 39, to enable manual or automatic control of ballasting and buoyancy of the floating dock 1 and positioning of the cleaning means 4*a*, 4*b*, and/or on individual panels of cleaning means. Alternatively the distance between the cleaning means and the side of a ship may be sensed employing sonar.

Where in the foregoing description reference has been made to specific components and integers of the invention having known equivalents then such equivalents are herein incorporated as if individually set forth.

Although the invention has been described by way of example, and with particular reference to the preferred embodiments shown in the accompanying drawings, it should be appreciated that variations and modifications may be made thereto, without departing from the scope of the invention as defined in the following claims.

I claim:

1. A floating dock adapted to clean ship hulls, said floating dock comprising a ship hull receiving means adapted to accommodate the beam of a ship, buoyancy means to control buoyancy of the receiving means, lateral cleaning means adapted to contact and clean at least a part of a side of a ship hull, adjustment means adapted to adjust the position of the lateral cleaning means to accommodate ships of different beam and self propulsion means adapted to manoeuvre the receiving means both forwards and/or backwards in the manner of a ship, to and from moored ships, and laterally along the length of a moored ship hull, and wherein said adjustment means and self propulsion means operate independently of a ship to be cleaned.

2. A floating dock according to claim 1 further comprising bottom cleaning means adapted to clean the bottom of a ship hull.

3. A floating dock according to claim 1 wherein the lateral cleaning means comprises a plurality of brushes, each brush in the form of a rotatable disc.

4. A floating dock according to claim 3 wherein the plurality of rotatable brushes of the lateral cleaning means are collectively positioned at least one lateral panel.

5. A floating dock according to claim 4 wherein the adjustment means are adapted to enable lateral adjustment of said at least one lateral panel towards and away from a ship hull, and tilt and/or rotation of said at least one lateral panel about a vertical axis.

6. A floating dock according to claim 3 wherein the plurality of rotatable brushes of the lateral cleaning means are provided on a plurality of cleaning panels, each cleaning panel separately adjustable by adjustment means.

7. A floating dock according to claim 6 wherein each adjustment means is adapted to enable lateral adjustment and tilt and/or rotation of a cleaning panel about its-vertical axis.

8. A floating dock according to claim 7 wherein each adjustment means comprises a telescopic arm controlled by hydraulic means and connected to its cleaning panel via a universal joint.

9. A floating dock according to claim 1 further comprising collection means adapted to collect debris cleaned off a ship hull by the cleaning means.

10. A floating dock according to claim 9 wherein the collection means comprises a collection chamber and dumping means for dumping collected debris.

11. A floating dock according to claim 9 wherein the collection means comprises a collection chamber and removal means adapted to remove collected debris from a lower part of the collection chamber into the ship hull receiving means whilst the floating dock is in operation and the collection chamber is submerged.

12. A method of cleaning a ship hull when in substantially open water, said method comprising:

manoeuvring a floating dock, in the manner of a ship, along a length direction of the floating dock to a moored ship by self propulsion means provided on the floating dock, submerging at least a part of a ship hull receiving means of the floating dock adapted to clean ship hulls and accommodate the beam of a ship, beneath the ship hull, contacting cleaning means of the floating dock with a part of at least one side of the ship hull, operating the cleaning means, and manoeuvring the floating dock laterally by the self propulsion means substantially the full length of the ship hull to clean at least one side thereof.

13. A method according to claim 12 further comprising controlling the position of the cleaning means during operation to maintain contact of the cleaning means with the ship hull substantially throughout its length.

14. A method according to claim 12 wherein said cleaning means contact both sides of the ship hull to enable cleaning of each side simultaneously.

15. A method according to claim 14 wherein said cleaning means also contact the bottom of the ship hull to enable simultaneous cleaning of the sides and bottom of the ship hull.

16. A method according to claim 12 further comprising collecting debris cleaned off the ship hull for subsequent processing and/or dumping remote from the site of cleaning.

17. A floating dock for cleaning ship hulls, said floating dock comprising a base having a front end and a rear end defining a length sufficient to accommodate the beam of a ship, said base further having longitudinal sides extending between said ends, at least one tower extending upwardly from said base at at least one of said front and rear ends thereof, buoyancy means for controlling buoyancy of the base and the tower for enabling said base to be selectively submerged beneath the ship hull, cleaning means disposed on said tower for cleaning a portion of a side of the ship hull when the base is disposed under the ship hull, adjustment means for adjusting the cleaning means in accordance with shapes and sizes of the ship hull, self propulsion means for moving the floating dock along forward and backward directions extending parallel to the length of the base to move the floating dock to and from moored ships, said self propulsion means further being for moving the floating dock laterally relative to the length of the base and along the length of a moored ship hull to enable said cleaning means to clean said side of said ship hull, said self propulsion means being operative independently of any operation of the ship to be cleaned.

18. The floating dock of claim 17, wherein the opposed sides of the base define a width for the base, the length of the base being substantially greater than the width.

19. The floating dock of claim 17, wherein the self propulsion means comprises a first propulsion means for propelling said floating dock in directions extending substantially parallel to length of the base and a second self propulsion means for propelling said floating dock transverse to said length of said base and along the length of the moored ship hull to be cleaned.

20. The floating dock of claim 19, wherein the self propulsion means further comprises at least a third self propulsion means disposed on said tower at a location above said base, said second and third self propulsion means cooperating for moving said floating dock laterally and along the length of the moored ship hull.

21. The floating dock of claim 17, herein the at least one tower comprises a front tower extending upwardly from the front end of the base and a rear tower extending upwardly from the rear end of the base, the towers being spaced apart sufficiently to accommodate the beam of the ship hull therebetween.

* * * * *